US009728866B2

(12) United States Patent
Liao

(10) Patent No.: US 9,728,866 B2
(45) Date of Patent: Aug. 8, 2017

(54) ELECTRICAL CONNECTOR

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/265,084

(22) Filed: Sep. 14, 2016

(65) Prior Publication Data

US 2017/0077621 A1 Mar. 16, 2017

(30) Foreign Application Priority Data

Sep. 15, 2015 (CN) ..... 2015 2 0710860 U

(51) Int. Cl.

| | |
|---|---|
| ***H01R 13/6586*** | (2011.01) |
| ***H01R 13/514*** | (2006.01) |
| ***H01R 9/22*** | (2006.01) |
| ***H01R 9/24*** | (2006.01) |
| ***H01R 12/72*** | (2011.01) |
| ***H01R 13/6585*** | (2011.01) |

(52) U.S. Cl.

CPC ..... *H01R 9/223* (2013.01); *H01R 9/2491* (2013.01); *H01R 12/721* (2013.01); *H01R 13/6585* (2013.01)

(58) Field of Classification Search

CPC ..... H01R 13/6586; H01R 13/514; H01R 13/6587; H01R 13/6585; H01R 23/688; H01R 13/65807; H01R 13/506

USPC ..... 439/607.06, 701

See application file for complete search history.

(56) References Cited

U.S. PATENT DOCUMENTS

| | | | | |
|---|---|---|---|---|
| 7,416,447 | B1 * | 8/2008 | Chen | H01R 13/6587 439/108 |
| 7,862,344 | B2 * | 1/2011 | Morgan | H01R 13/6467 439/108 |
| 7,867,045 | B2 * | 1/2011 | McAlonis | H01R 13/052 439/682 |

(Continued)

FOREIGN PATENT DOCUMENTS

| | | |
|---|---|---|
| TW | M267697 | 6/2005 |
| TW | M393890 | 12/2010 |

*Primary Examiner* — Gary Paumen

(74) *Attorney, Agent, or Firm* — Wei Te Chung; Ming Chieh Chang

(57) ABSTRACT

An electrical connector comprises a plurality of terminal blocks arranged along a transverse direction. The terminal block includes a vertical insulative plate, a pair of first terminals, and a pair of second terminals. The first terminal includes a first deflectable contacting arm and a first connecting foot. The second terminal includes a second deflectable contacting arm and a second connecting foot. The first deflectable contacting arm and the second deflectable contacting arm are arranged one by one along the transverse direction. The first deflectable contacting arms of the pair of first terminals bend in a face to face style to form an inserting space in the vertical direction. The second deflectable contacting arms of the pair of second terminals bend in a face to face style to form the inserting space in the vertical direction.

16 Claims, 9 Drawing Sheets

(56) References Cited

U.S. PATENT DOCUMENTS

| | | | | |
|---|---|---|---|---|
| 8,157,595 | B2 * | 4/2012 | Saraswat | H01R 13/6587 439/607.06 |
| 8,398,431 | B1 * | 3/2013 | Whiteman, Jr. | H01R 13/6587 439/607.06 |
| 8,500,487 | B2 * | 8/2013 | Morgan | H01R 13/6595 439/607.06 |
| 8,529,300 | B2 * | 9/2013 | Ritter | H01R 13/514 439/701 |
| 2002/0102885 | A1 * | 8/2002 | Kline | H01R 23/688 439/701 |
| 2003/0186594 | A1 * | 10/2003 | Davis | H01R 23/688 439/701 |
| 2004/0043661 | A1 * | 3/2004 | Okada | H01R 13/405 439/607.06 |
| 2004/0077228 | A1 * | 4/2004 | Wu | H01R 13/514 439/701 |
| 2013/0164998 | A1 * | 6/2013 | Yu | H01R 12/724 439/701 |

* cited by examiner

ELECTRICAL CONNECTOR

FIELD OF THE INVENTION

The present invention relates to an electrical connector.

DESCRIPTION OF THE PRIOR ART

Taiwan Patent Issued No. M393890 discloses an electrical connector including an insulative housing, a plurality of terminals received in the insulative housing and a shell covering the insulative housing. The insulative housing has an inserting space for receiving a mating connector. The terminal has a mating portion protruding to the inserting space. When the electrical connector is mating with a card edge of a Central processing unit, a length of the electrical connector and the number of the terminals are unchangable.

It is desired to obtain a new electrical connector.

SUMMARY OF THE INVENTION

Accordingly, an object of the present invention is to provide an electrical connector comprising a plurality of terminal blocks arranged along a transverse direction. The terminal block includes a vertical insulative plate, a pair of first terminals, and a pair of second terminals. The pair of first terminals and the pair of second terminals are fixed in the vertical insulative plate. The first terminal includes a first deflectable contacting arm extending beyond a front face of the vertical insulative plate and a first connecting foot. The second terminal includes a second deflectable contacting arm extending beyond a front face of the vertical insulative plate and a second connecting foot. The first deflectable contacting arm and the second deflectable contacting arm are arranged one by one along the transverse direction. The first deflectable contacting arms of the pair of first terminals bend in a face to face style to form an inserting space in the vertical direction. The second deflectable contacting arms of the pair of second terminals bend in a face to face style to form the inserting space in the vertical direction.

DESCRIPTION OF PREFERRED EMBODIMENT

Reference will now be made to the drawings to describe the present invention in detail.

Figure 1:
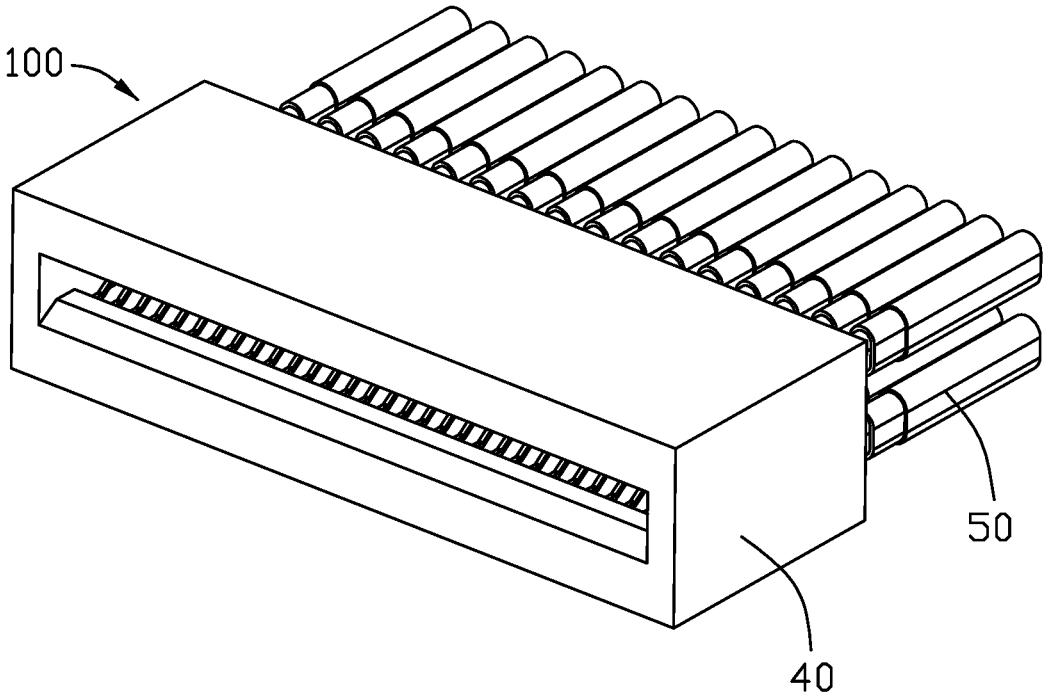
FIG. 1 is a perspective view of an electrical connector with a cable in accordance with the present invention.
Figure 2:
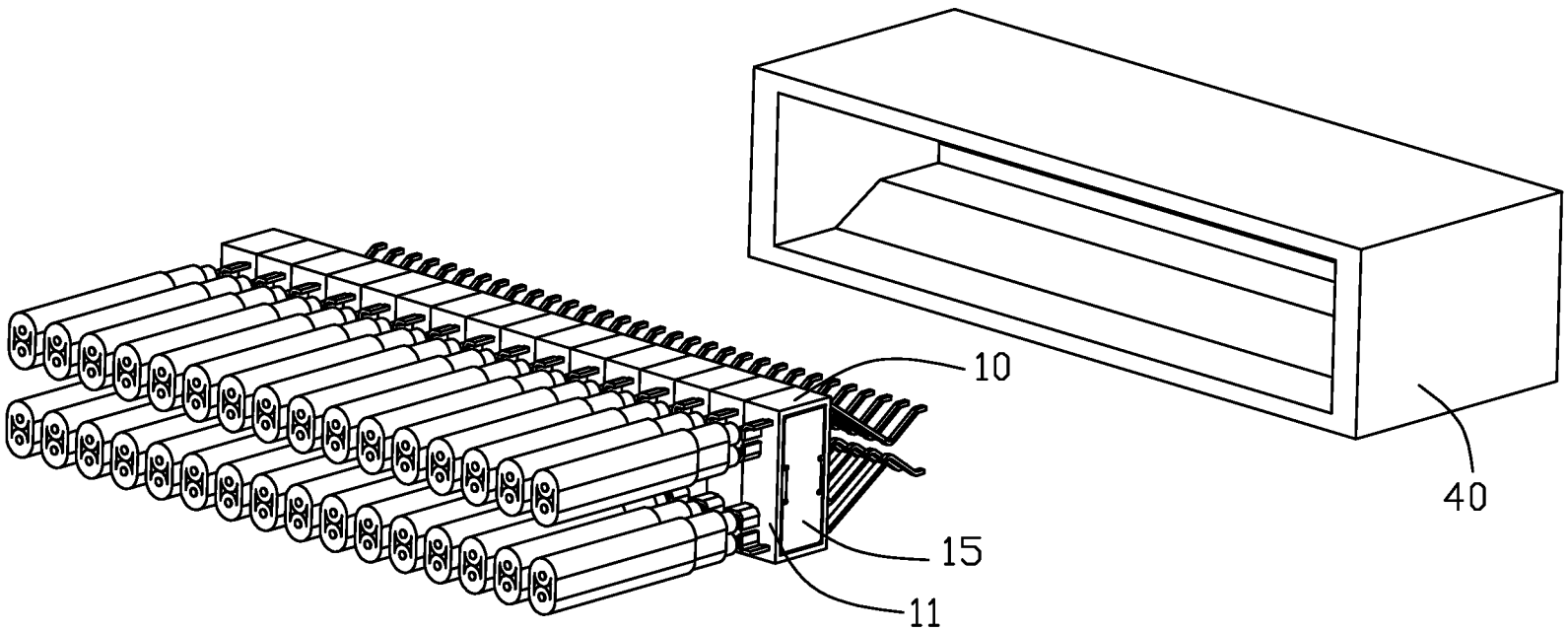
FIG. 2 is an exploded perspective view of the electrical connector and the cable shown in FIG. 1.
Figure 3:
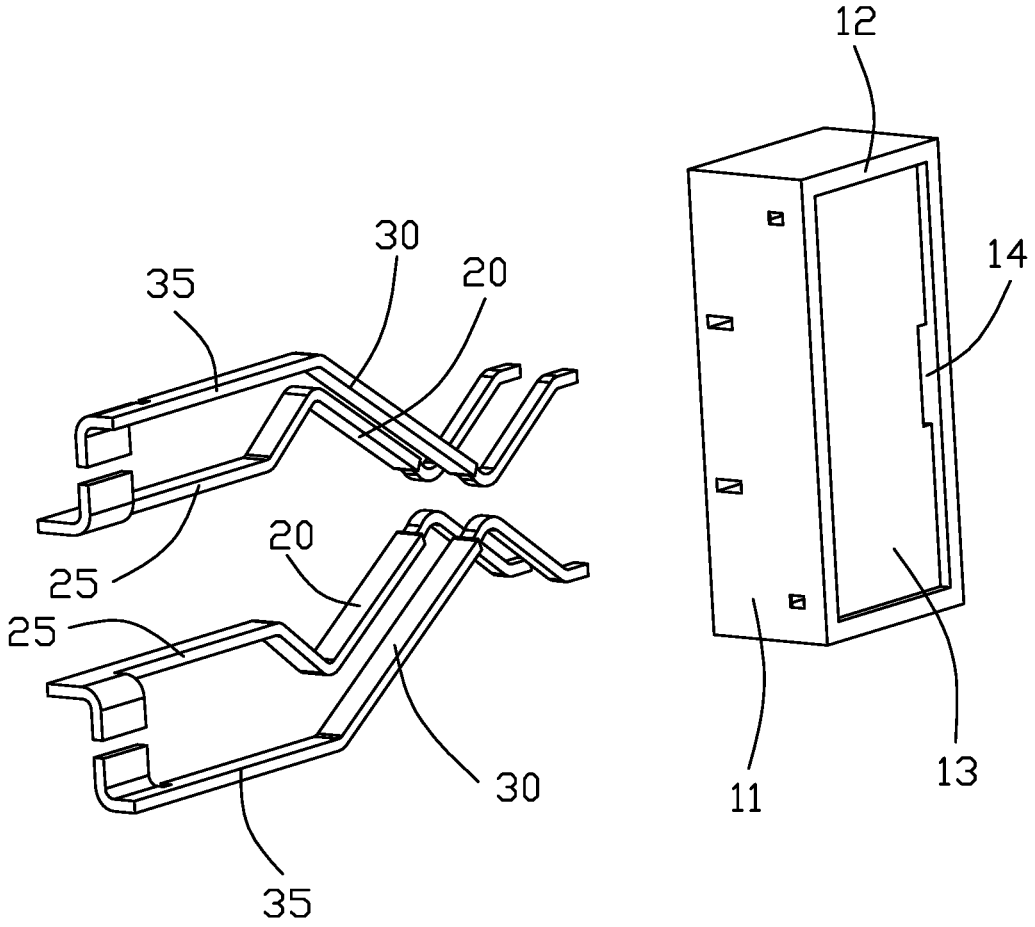
FIG. 3 is an exploded perspective view of a terminal block without the cable shown in FIG. 2.

Referring to FIGS. 1-2, an electrical connector 100 is used for mating with a card edge of a Central Processing Unit. The electrical connector 100 includes a plurality of terminal blocks 10 arranged along a transverse direction, a shell 40 covering and fixing the terminal blocks 10, and a plurality of cables 50. The number of the terminal blocks 10 can be adjusted to adapt to different widths of the card edge of the Central Processing Units. The terminal block 10 includes an vertical insulative plate 11 and a plurality of terminals fixed in the insulative plate 11. The terminal block 10 also includes a shielding plate 15. The terminals are insert molded in the vertical insulative plate 11.

Referring to FIGS. 3-7, the terminal block 10 includes an vertical insulative plate 11 disposed along a vertical direction perpendicular to the transverse direction, and a pair of first terminals 20 and a pair of second terminals 30 fixed in the vertical insulative plate 11. In the vertical direction, the pair of first terminals 20 are arranged symmetrically, the pair of second terminals 30 are also arranged symmetrically. The first terminal 20 includes a first deflectable contacting arm 21 extending beyond a front face of the vertical insulative plate 11 and a first connecting foot 22 extending beyond a rear face of the vertical insulative plate 11. The first terminal 20 also includes a first fixing portion 25 connecting the first deflectable contacting arm 21 and the first connecting foot 22. The first fixing portion 25 is fixed in the vertical insulative plate 11. The second terminal 30 includes a second deflectable contacting arm 31 extending beyond a front face of the vertical insulative plate 11 and a second connecting foot 32 extending beyond a rear face of the vertical insulative plate 11. The second terminal 30 also includes a second fixing portion 35 connecting the second deflectable contacting arm 31 and the second connecting foot 32. The second fixing portion 35 is fixed in the vertical insulative plate 11. In the transverse direction, the first deflectable contacting arm 21 of the first terminal 20 and the second deflectable contacting arm 31 of the second terminal 30 are arranged in a side-to-side manner. The first fixing portion 25 of the first terminal 20 and the second fixing portion 35 of the second terminal 30 are arranged symmetrically in the vertical direction. The first connecting foot 22 of the first terminal 20 and the second connecting foot 32 of the second terminal 30 are arranged symmetrically in the vertical direction. The first deflectable contacting arms 21 of the pair of first terminals 20 are arranged along the vertical direction to form an inserting space. The second deflectable contacting arms 31 of the pair of second terminals 30 are also arranged along the vertical direction to form the inserting space. The inserting space is formed by the first deflectable contacting arms 21 and the second deflectable contacting arms 31. In the vertical direction, the first fixing portions 25 of the pair of first terminals 20 are arranged symmetrically, and the first connecting feet 22 of the pair of first terminals 20 are also arranged symmetrically. The second fixing portions 35 of the pair of second terminals 30 are arranged symmetrically, and the second connecting feet 32 of the pair of second terminals 30 are also arranged symmetrically.

Figure 8:
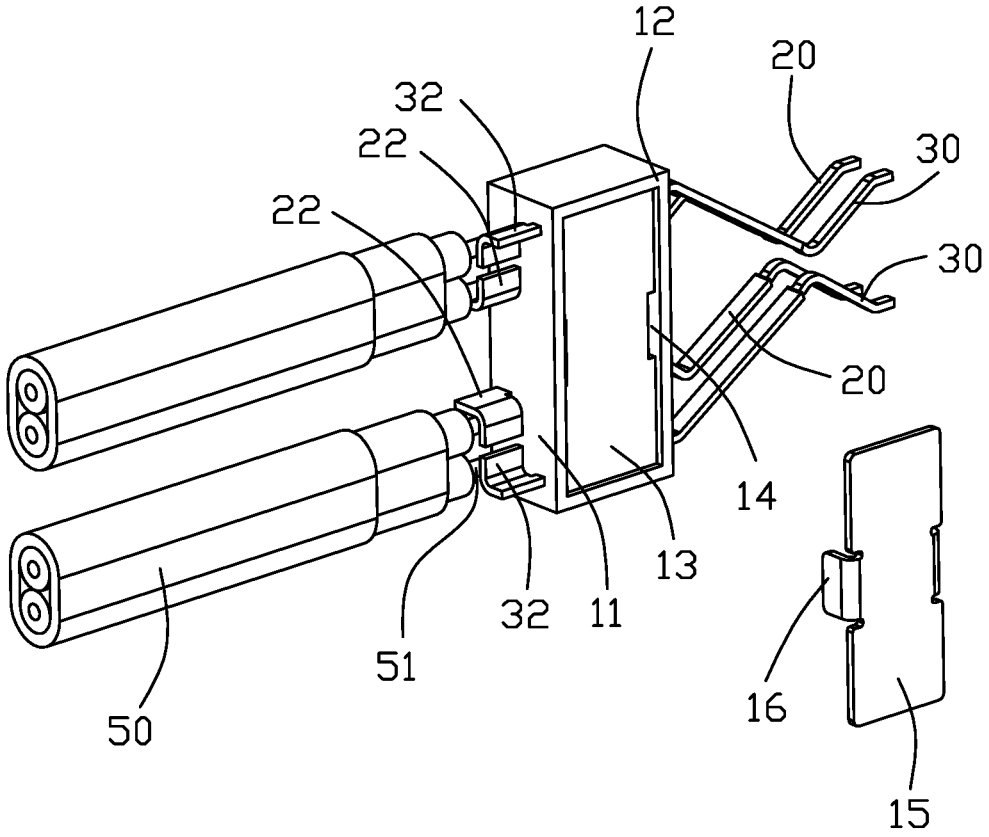
FIG. 8 is an exploded perspective view of a shielding plate separating from the terminal block shown in FIG. 2.
Figure 9:
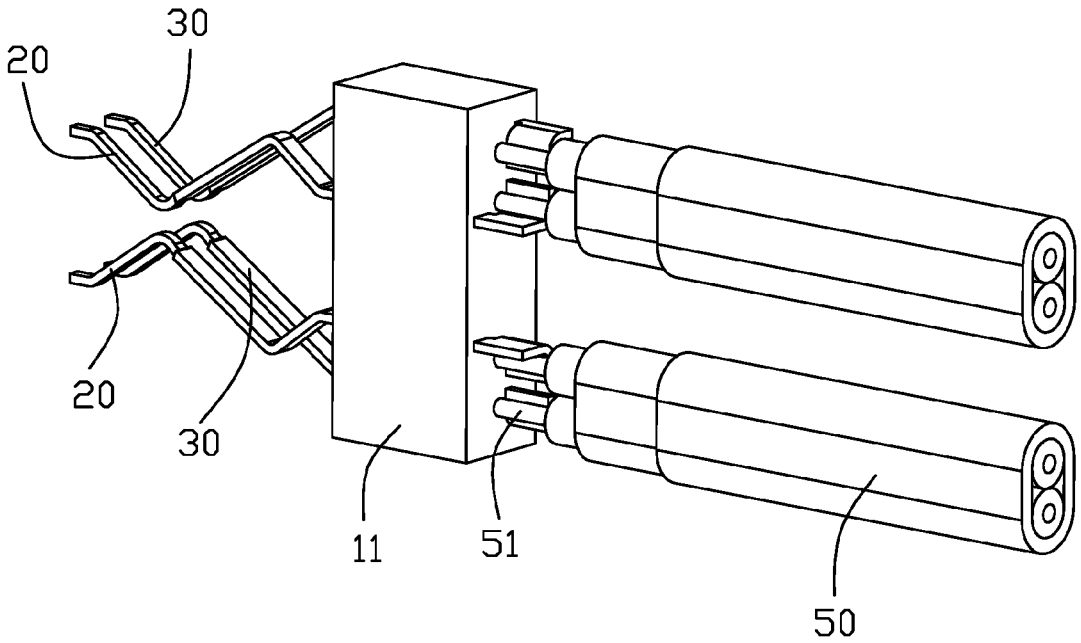
FIG. 9 is another perspective view shown in FIG. 8.

Referring to FIGS. 8-9, the vertical insulative plate 11 includes two side faces 12 connecting a front face and a rear face, and one of the side faces 12 is attached with a shielding plate 15. The vertical insulative plate 11 includes a sag with a fixing hole 14 on the side face. The shielding plate 15 includes a fixing slice 16 mounted in the fixing hole 14 to cooperate with the vertical insulative plate 11 and the shielding plate 15 closely. The cable 50 includes two core wires 51 connected with the terminal block 10. The first connecting foot 22 and the second connecting foot 32 disposed at one side of the inserting space connect two core wires 51 of the cable 50, respectively. The pair of the first connecting feet 22 disposed at two sides of the inserting space are soldered with two different cables 50. The pair of the second connecting feet 32 disposed at two sides of the inserting space are also soldered with two different cables 50.

Figure 4:
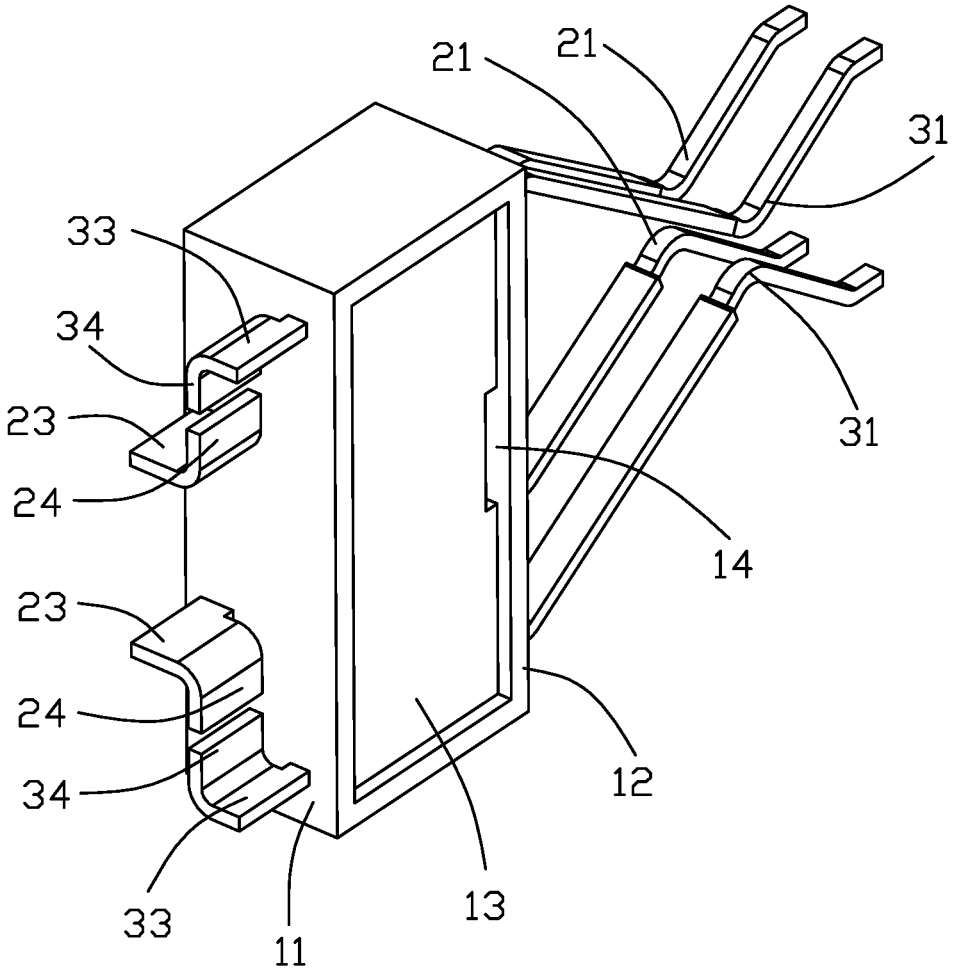
FIG. 4 is a perspective view of the terminal block shown in FIG. 3.
Figure 5:
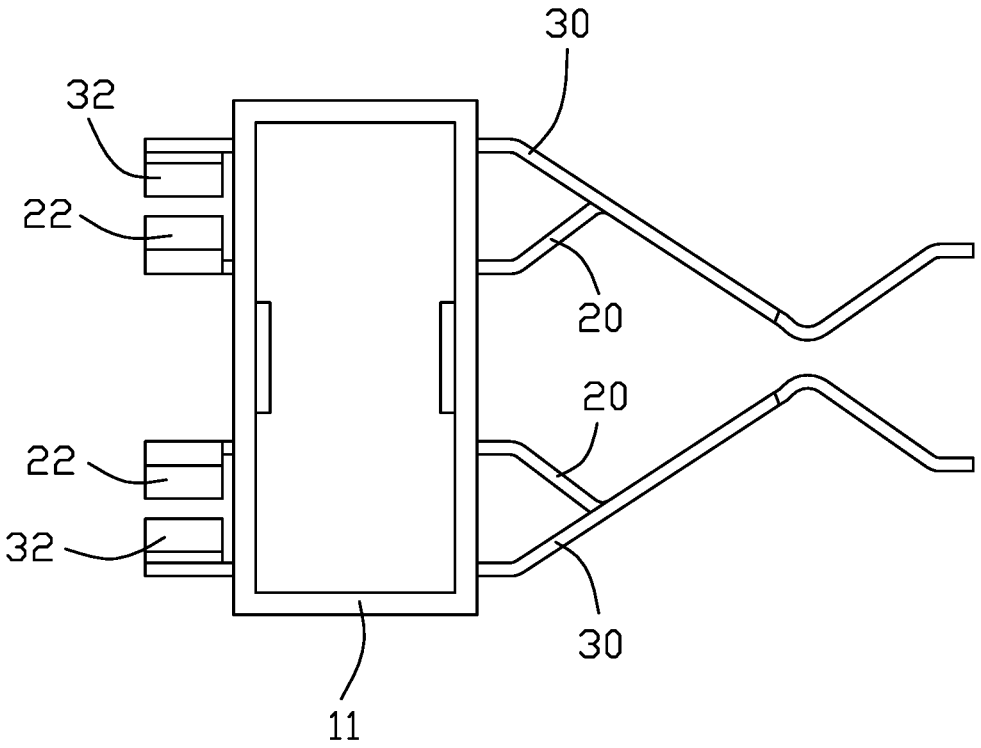
FIG. 5 is a front view of the terminal block shown in FIG. 4.
Figure 6:
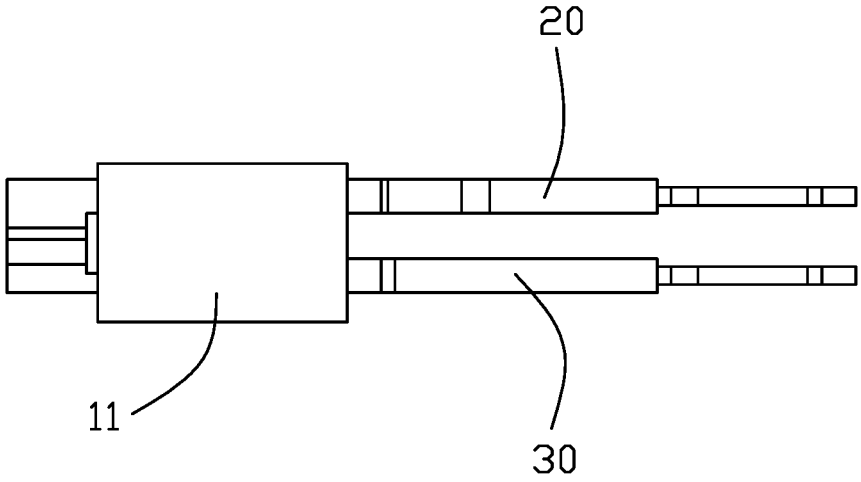
FIG. 6 is a top view of the terminal block shown in FIG. 4.
Figure 7:
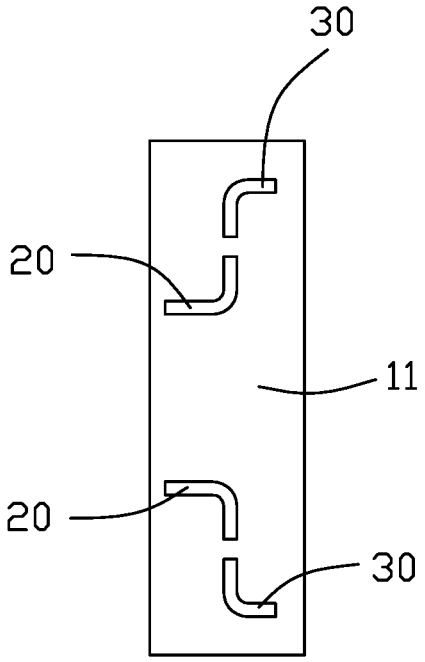
FIG. 7 is a left view of the terminal block shown in FIG. 4.

Referring to FIG. 4, the first connecting foot 22 includes a first connecting portion 23 extending from the first fixing portion 25 of the first terminal 20 and a second connecting portion 24 bending from the first connecting portion 23. The second connecting foot 32 includes a third connecting portion 33 extending from the second fixing portion 35 and a fourth connecting portion 34 bending from the third connecting portion 33. The first connecting portion 23 and the third connecting portion 33 disposed at one side of the inserting space extend in two opposite directions. The second connecting portion 24 and the fourth connecting portion 34 disposed at one side of the inserting space are aligned in the vertical direction. In the vertical direction, the first connecting portions 23 of the pair of the first terminals 20 extend to one direction in parallel, and the third connecting portions 33 of the pair of the second terminals 30 extend to one direction in parallel. Each of the second connecting portion 24 and the fourth connecting portion 34 is soldered with a cable 50.

Notably, in this embodiment the pair of first terminals 20 are located between the pair of second terminals 30 wherein the pair of first terminals 20 are symmetrically arranged and aligned with each other in the vertical direction with the receiving space defined between the corresponding two first deflectable contacting arms 21, and the pair of second terminals 30 are symmetrically arranged and aligned with each other in the vertical direction too with the receiving space defined between the corresponding two second deflectable contacting arms 31. Anyhow, in another embodiment the first deflectable contacting arm 21 of the upper first terminal 20 is aligned with the second deflectable contacting arm 31 of the lower second terminal 30 with the receiving space defined therebetween in the vertical direction while the first deflectable contacting arm 21 of the lower first terminal 20 is aligned with the second deflectable contacting arm 32 of the upper second terminal 30 in the vertical direction. Understandably, in such an alternate embodiment, in each corresponding pair the corresponding first terminal 20 and the corresponding second terminal 30 are essentially asymmetrical with each other in the vertical direction. Moreover, in the first embodiment the core wires 51 is soldered to the interior side of the corresponding L-shaped first connecting foot 22 while the core 51 is soldered to the exterior side of the corresponding L-shaped second connecting foot 32. Alternately, the core wire 51 may be soldered upon the interior side of the corresponding L-shaped second connecting foot 32, if necessary.

From another viewpoint, one feature of the invention is to provide a first terminal 20 and a second terminal 30 respectively connected to the pair of core wires of a differential pair cable wherein the first fixing section 25 of the first terminal 20 and the second fixing section 35 of the second terminal 30 are essentially spaced from each other in the vertical direction while the deflectable contacting arm 21 of the first terminal 20 and the second deflectable contacting arm 31 of the second terminal 30 are essentially side by side arranged with each other along the transverse direction. The first connecting foot 22 extending from the first fixing section 25 is further equipped with a first soldering region to be soldered with one core wire of the differential pair cable, and the second connecting foot 32 extending from the second fixing section 35 is further equipped with a second soldering region to be soldered with the other core wire of the same differential pair cable, wherein said first soldering region is essentially aligned with the second soldering region in the vertical direction so as to allow said core wires of the differential pair cable to extend in a vertical plane rather than in an oblique or horizontal plane. Furthermore, in the invention one differential pair cable 50 and another differential pair cable 50 are unified together within a same terminal block 10, and the corresponding terminals of those two differential pair cables 50 are respectively located by two sides of the receiving space between the corresponding deflectable contacting sections of the terminals, and the deflectable contacting sections of the corresponding terminals corresponding to the same differential pair cable are arranged to be space from each other in the transverse direction.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a plurality of terminal blocks arranged along a transverse direction, the terminal block having a vertical insulative plate extending along a vertical direction perpendicular to the transverse direction;

a pair of first terminals fixed in the vertical insulative plate, each first terminal having a first deflectable contacting arm extending beyond a front face of the vertical insulative plate and a first connecting foot; and a pair of second terminals fixed in the vertical insulative plate, each second terminal having a second deflectable contacting arm extending beyond the front face of the vertical insulative plate and a second connecting foot; wherein the first deflectable contacting arms and the second deflectable contacting arms are arranged one by one along the transverse direction, the first deflectable contacting arms of the pair of first terminals bend in a face to face style to form an inserting space in the vertical direction, the second deflectable contacting arms of the pair of second terminals bend in a face to face style to form the inserting space in the vertical direction.

2. The electrical connector as claimed in claim 1, wherein the first terminal has a first fixing portion connecting with the first deflectable contacting arm and the first connecting foot, the first fixing portion is fixed in the vertical insulative plate, the second terminal has a second fixing portion connecting with the second deflectable contacting arm and the second connecting foot, the second fixing portion is fixed in the vertical insulative plate.

3. The electrical connector as claimed in claim 2, wherein the first connecting foot has a first connecting portion extending from the first fixing portion and a second connecting portion bending from the first connecting portion, the second connecting foot has a third connecting portion extending from the second fixing portion and a fourth connecting portion bending from the third connecting portion, the first connecting portion and the third connecting portion extend along two opposite directions, the second connecting portion and the fourth connecting portion are aligned along the vertical direction.

4. The electrical connector as claimed in claim 3, wherein the first connecting portions of the pair of the first terminals extend parallel to each other.

5. The electrical connector as claimed in claim 4, wherein the third connecting portions of the pair of the second terminals extend in a same direction, each of the second connecting portion and the fourth connecting portion provides a wire welding area.

6. The electrical connector as claimed in claim 1, wherein the vertical insulative plate has two lateral faces connecting a front face and a rear face, and one of the lateral faces is attached with a shielding plate.

7. The electrical connector as claimed in claim 6, wherein the vertical insulative plate has a sag with a fixing hole at one of the lateral faces, and the shielding plate has a fixing slice mounted into the fixing hole.

8. The electrical connector as claimed in claim 1, further comprising a plurality of cables, each of the cables has two core wires, each of the terminal blocks has two cables, the first terminal and the second terminal disposed at one side of the inserting space are connected with two core wires of the cable, respectively.

9. An electrical connector comprising:

a terminal block including a first terminal and a second terminal retained in a same insulator and linked to a same differential pair cable with two core wires thereof, the first terminal including a first fixing section retained in the insulator, a first deflectable contacting arm extending forwardly from the first fixing section, and a first connecting section extending rearwardly from the first fixing section;

the second terminal including a second fixing section retained in the insulator, a second deflectable contacting section extending forwardly form the second fixing section, and a second connecting section extending rearwardly from the second fixing section;

the first fixing section being spaced from the second fixing section in a vertical direction while the first deflectable contacting arm being side by side arranged with the second deflectable contacting arm along a transverse direction perpendicular to said vertical direction; and the first connecting section defining a first soldering region soldered to one of said two core wires, the second connecting section defining a second soldering region soldered to the other of said two core wires; wherein said first soldering region and said second soldering region are spaced from each other in the vertical direction while being close to each other in the transverse direction so as to allow the corresponding two core wires of the differential pair cable to extend essentially in a vertical plane rather than in an oblique plane or a horizontal plane.

10. The electrical connector as claimed in claim 9, wherein each of said first connecting section and said second connection section defines an L-shaped structure.

11. The electrical connector as claimed in claim 10, wherein the L-shaped structure of the first connecting section is symmetrical with regard to that of the second connecting section in both the vertical direction and the transverse direction.

12. The electrical connector as claimed in claim 9, further including another first terminal and another second terminal retained in the same insulator in an aligned and symmetrical manner with regard to the corresponding first terminal and second terminal in the vertical direction.

13. The electrical connector as claimed in claim 12, wherein said first terminal and said another first terminal are located between said second terminal and said another second terminal in the vertical direction in a side view.

14. The electrical connector as claimed in claim 13, wherein a first receiving space is formed between said first terminal and said another first terminal in the vertical direction, and a second space is formed between said second terminal and said another second terminal in the vertical direction, said first receiving space being dimensioned similar to said second receiving space in the vertical direction.

15. The electrical connector as claimed in claim 14, wherein said another first terminal and said another second terminal are linked with two corresponding core wires of another differential pair cable.

16. The electrical connector as claimed in claim 15, wherein there are more than two terminal blocks are side by side stacked with one another along the transverse direction so as to have the corresponding first receiving spaces and second receiving spaces of said terminal blocks to commonly form a card edge receiving space in said transverse direction.

* * * * *